United States Patent [19]

Masui

[11] Patent Number: 4,574,952

[45] Date of Patent: Mar. 11, 1986

[54] BOX CONTAINING FACIAL TISSUES

[76] Inventor: Toshimune Masui, 4-3, Okata, 3-chome, Kashiwara-shi, Osaka, Japan

[21] Appl. No.: 654,674

[22] Filed: Sep. 26, 1984

[30] Foreign Application Priority Data

Jul. 14, 1984 [JP] Japan ..... 59-106895[U]

[51] Int. Cl.[4] ..... B65D 83/08; B65D 65/28; B65D 77/30; B65H 3/00

[52] U.S. Cl. ..... 206/494; 206/460; 206/804; 206/813; 221/37; 221/48; 221/63

[58] Field of Search ..... 206/449, 494, 460, 45.34, 206/409, 804, 813; 221/37, 48, 63

[56] References Cited

U.S. PATENT DOCUMENTS 1,205,892 11/1916 Hecht ..... 221/37
2,864,495 12/1958 Ritchie ..... 206/409
2,921,676 1/1960 Carignan ..... 206/409
3,239,097 3/1966 Bates et al. ..... 206/45.34
3,276,622 10/1966 Krzyzanowski ..... 221/37

FOREIGN PATENT DOCUMENTS 661066 11/1951 United Kingdom ..... 206/804

*Primary Examiner*—William T. Dixson, Jr.
*Attorney, Agent, or Firm*—Wenderoth, Lind & Ponack

[57] ABSTRACT

In a box containing facial tissues, a tape is attached to the under surface of an oval portion surrounded by a perforated line. In the alternative, thick strings are attached along and inwardly of the longitudinal edges of the oval portion. The tape or thick strings serve as backings and facilitate tearing the top sheet along the perforated line. The uppermost one of the facial tissues is attached to the under surface of the oval portion. In the alternative, the oval portion is formed with a hole through which an adhesive tape is pushed to adhere to the uppermost tissue.

6 Claims, 8 Drawing Figures

BOX CONTAINING FACIAL TISSUES

BACKGROUND OF THE INVENTION

The present invention relates to a box containing facial tissues, and more particularly to a box which can be easily opened and from which the uppermost facial tissue can be easily removed.

As an example of conventional boxes containing facial tissues, FIG. 8 shows a carton 1 in the shape of a rectangular parallelepiped, in which a plurality of folded facial tissues 2 are stacked and intertwined with one another so as to be drawn out one after another. A perforated line 4 for forming an oval outlet for the facial tissues 2 is provided on the top sheet or wall 3 of the carton 1. A transparent film 5 attached to the under surface of the top sheet 3 has a slot 9 so that a facial tissue 2 half drawn out therethrough will stand erect. In order to open the carton 1, a portion of the perforated line 4 is torn by pushing thereagainst with a finger tip, and an oval piece defined by perforated line 4 is removed from the top sheet 3.

The above-described conventional carton 1 has a disadvantage that sometimes such opening is not easy because deviation from the perforated line 4 sometimes occurs in tearing the oval portion. When such deviation occurs, the edge of the oval outlet has a poor appearance. The conventional carton 1 has another disadvantage that it is difficult to remove the uppermost facial tissue 2, because its edge is behind the top sheet 3.

SUMMARY OF THE INVENTION

It is an object of the present invention to provide a box which obviates the above-described disadvantages. In accordance with the present invention, a tape or strings are attached to the under surface of the top sheet along a perforated line provided in the top sheet and the uppermost of the facial tissues is attached to the under surface of the portion surrounded by the perforated line.

The box in accordance with the present invention has an advantage that, because of the provision of the tape or strings, the oval piece surrounded by the perforated line can be easily torn from the top sheet and the edge of the oval outlet thus formed has a fine appearance.

The box in accordance with the present invention has another advantage that the uppermost facial tissue can be easily drawn out because it is attached to the under surface of the oval piece to be removed from the top sheet.

With the above-described object in view and as will become apparent from the following detailed description, the present invention will be more clearly understood in connection with the accompanying drawings.

DETAILED DESCRIPTION OF THE INVENTION

Figure 1:
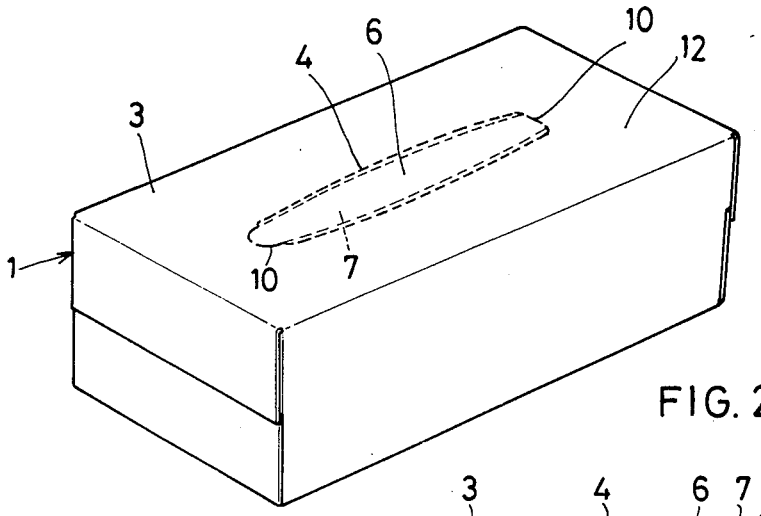
FIG. 1 is a perspective view of a first embodiment of the present invention.
Figure 2:
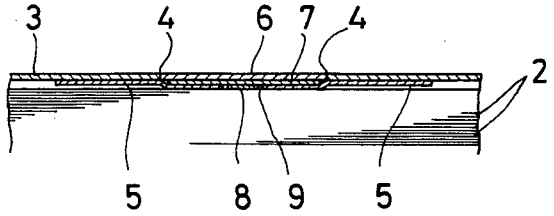
FIG. 2 is a vertical sectional side view of the upper part thereof.
Figure 3:
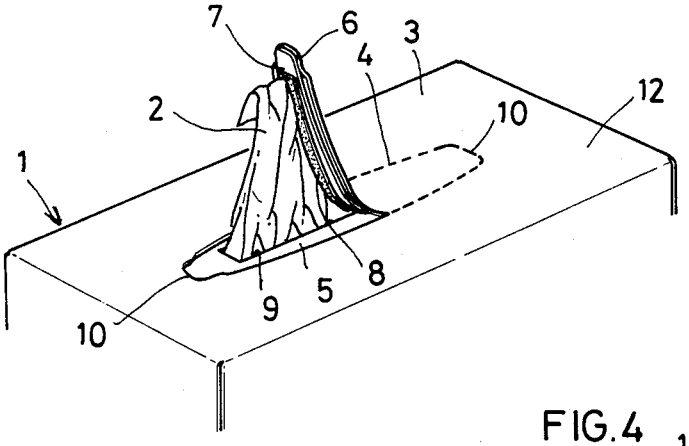
FIG. 3 is a perspective view thereof, illustrating an oval portion thereof half-opened.

Referring now to FIGS. 1 to 3, the first embodiment of the present invention includes a carton 1 in the shape of a rectangular parallelepiped in which a plurality of folded facial tissues 2 are stacked and interwined with one another so as to be drawn out one after another. A perforated line 4 for forming an oval outlet for the facial tissues 2 is provided in the central part of a top sheet or wall 3 of the carton 1 and defines a boundary between an oval portion 6 adapted to be torn off and a remaining portion 12 of the top sheet 3. A strip of tape 7 made of cardboard, plastic or cloth is attached to the under surface of the portion 6 to serve as a backing, and the uppermost facial tissue 2 is attached to the under surface of the tape 7 by a double-sided pressure sensitive adhesive tape 8. A transparent film 5 larger in size than the portion 6 is attached to the under surface of the top sheet 3 so as to be disposed under the tape 7. The film 5 has a rectangular slot 9. A facial tissue 2 is supported erect in the slot 9 when it is half drawn out through the latter.

At the longitudinally opposite ends of the portion 6, the perforated line 4 is formed into slits 10, into one of which a finger tip is thrust and the end of the portion 6 is picked up as shown in FIG. 3. Then the top sheet 3 can be easily torn along the perforated line 4, because nearly the entire surface of the portion 6 is lined or backed with the tape 7. When the end of the portion 6 is raised, the uppermost facial tissue 2 is pulled through the slot 9.

In order to provide space for the insertion of a finger tip and thereby allow the end of the portion 6 to be easily picked up, half-moon shaped notch may be cut in the portion 12 outside of the slits 10.

The slot 9 is large enough to allow the facial tissue 2 easily to pass therethrough. Transverse slits are provided in the longitudinal edges of the slot 9 to facilitate the removal of the facial tissue 2.

Figure 4:
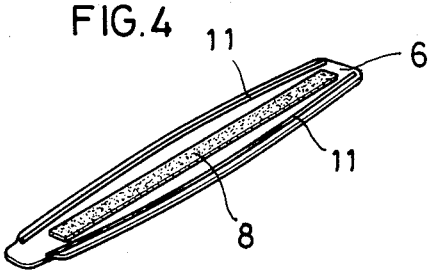
FIG. 4 is a perspective view of the reverse side of an oval portion used in a second embodiment of the present invention.

Referring now to the second embodiment of the present invention shown in FIG. 4, thick strings 11 take the place of the tape 7 as a backing means for facilitating tearing along the perforated line 4. The strings 11 are attached to the under surface of the top sheet 3 along and inwardly of the longitudinal edges of the portion 6. Instead of the strings 11, synthetic resin may be injected through the perforated line 4 to form a backing means.

In place of the double-sided pressure sensitive adhesive tape 8, other fastening means such as a clip, a magnet, a thread, a staple formed by a wire-stitching machine, or a hot-melt adhesive injected through a small hole may be used to attached the uppermost one of the facial tissues 2 on the under surface of the portion 6.

Figure 5:
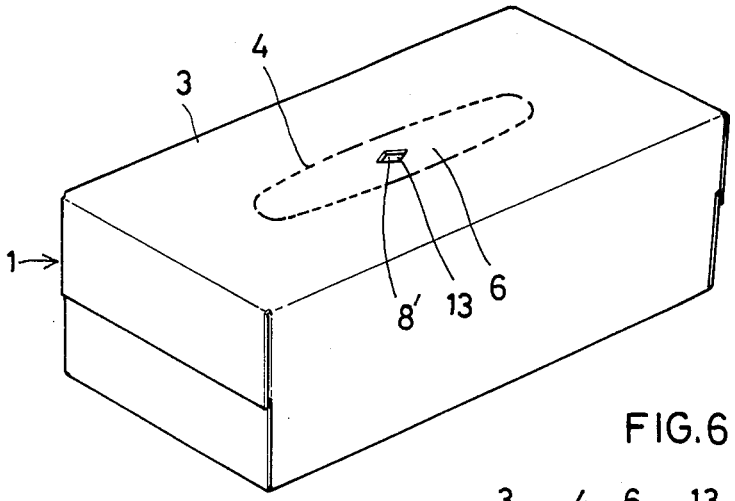
FIG. 5 is a perspective view of a third embodiment of the present invention.
Figure 6:
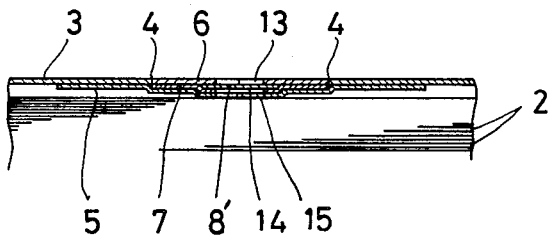
FIG. 6 is a vertical sectional side view of the upper part thereof.
Figure 7:
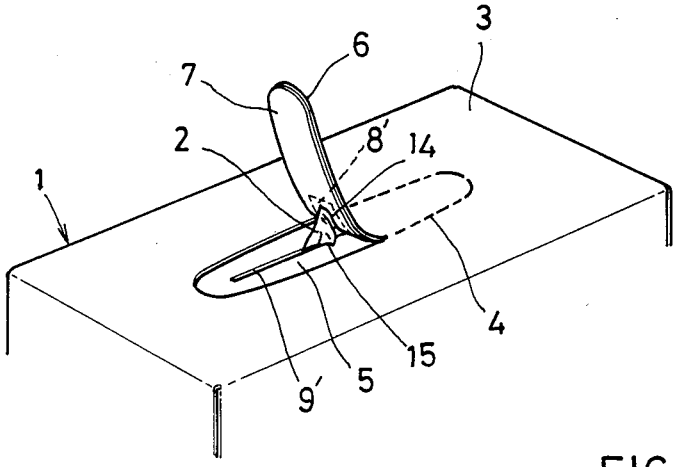
FIG. 7 is a perspective view thereof, illustrating an oval portion thereof half-opened.
Figure 8:
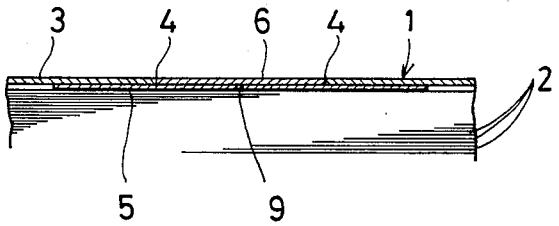
FIG. 8 is a vertical sectional side view of the upper part of a conventional box.

Referring now to FIGS. 5 to 7, the third embodiment of the present invention is different from the above embodiments in that a rhombic opening 13 is provided in the central part of the oval portion 6, that another rhombic opening 14 is provided in the central part of the tape 7 just below the opening 13, that a transparent adhesive tape 8' is held between the portion 6 and the tape so as to cover the opening 14 with the adhesive side facing downwardly, that the transparent film 5 has a rectilinear slot 9' instead of the rectangular slot 9 of the above embodiments, and that notches 15 are cut in the longitudinal edges of the slot 9' at positions corresponding to the position of the openings 13 and 14.

Prior to peeling the portion 6, the adhesive tape 8' in the opening 13 is pushed by a finger tip so that the uppermost facial tissue 2 may be stuck on the under surface of the adhesive tape 8'. The uppermost facial tissue 2 is drawn out when the portion 6 is peeled from the top sheet 3.

In consideration of the design, the openings 13 and 14 may be circular or of any other shape instead of being rhombic. The transparent adhesive tape 8' permits the customers to see the color of the facial tissues 2 contained in the carton 1 when purchasing.

What I claim is:

1. In a box containing a plurality of folded facial tissues stacked and intertwined with one another so as to be withdrawn one after another from said box, said box including a top wall having therein perforations defining a portion to be removed from said top wall to form an outlet for withdrawal of said tissues, and a sheet attached to the under surface of said top wall to span said outlet, said sheet having therein a slit through which said tissues may be withdrawn, the improvement comprising:

backing means mounted on the under surface of said portion for facilitating separation thereof along said perforations from said top wall; and sticking means directed downwardly from said portion for sticking to the uppermost said tissue to ensure withdrawal thereof through said slit and said outlet upon removal of said portion from said top wall.

2. The improvement claimed in claim 1, wherein said sticking means comprises double-sided adhesive tape attached to the under surface of said backing means.

3. The improvement claimed in claim 1, wherein said backing means comprises a strip of tape.

4. The improvement claimed in claim 3, wherein said portion and said strip of tape have therein aligned respective openings, and said sticking means comprises a one-sided adhesive tape positioned between said portion and said strip of tape, with the adhesive of said adhesive tape exposed to the interior of said box through said opening in said strip of tape.

5. The improvement claimed in claim 1, wherein said backing means comprises elongated string-like members attached to said under surface of said portion at positions adjacent said perforations.

6. The improvement claimed in claim 1, wherein said backing means comprises resin material injected through said perforations.

* * * * *